US005589009A

United States Patent [19]

Kim et al.

[11] Patent Number: 5,589,009

[45] Date of Patent: Dec. 31, 1996

[54] RE-FE-B MAGNETS AND MANUFACTURING METHOD FOR THE SAME

[75] Inventors: Andrew S. Kim, Pittsburgh; Floyd E. Camp, Trafford, both of Pa.

[73] Assignee: Crucible Materials Corporation, Syracuse, N.Y.

[21] Appl. No.: 462,959

[22] Filed: Jun. 5, 1995

Related U.S. Application Data

[62] Division of Ser. No. 235,279, Apr. 29, 1994, Pat. No. 5,480,471.

[51] Int. Cl.[6] ..... H01F 1/053

[52] U.S. Cl. ..... 148/302; 420/83; 420/121

[58] Field of Search ..... 148/302; 420/83, 420/121

[56] References Cited

U.S. PATENT DOCUMENTS

| | | | |
|---|---|---|---|
| 3,885,995 | 5/1975 | Cunningham et al. | 148/217 |
| 4,485,163 | 11/1984 | Miyakawa | 148/105 |
| 4,563,223 | 1/1986 | Dawes et al. | 148/217 |
| 4,767,450 | 8/1988 | Ishigaki et al. | 148/302 |
| 4,769,063 | 9/1988 | Ishigaki et al. | 148/302 |
| 5,091,020 | 2/1992 | Kim | 148/101 |
| 5,123,979 | 6/1992 | Tenaud et al. | 148/302 |
| 5,162,064 | 11/1992 | Kim et al. | 420/83 |
| 5,230,751 | 7/1993 | Endoh et al. | 148/302 |
| 5,372,629 | 12/1994 | Anderson et al. | 75/349 |

FOREIGN PATENT DOCUMENTS

| | | | |
|---|---|---|---|
| 0517355A1 | 12/1992 | European Pat. Off. . | |
| 597582 | 5/1994 | European Pat. Off. | 148/302 |
| 43-14133 | 2/1978 | Japan . | |
| 3-188241 | 8/1991 | Japan . | |
| WO90/16075 | 12/1990 | WIPO . | |

OTHER PUBLICATIONS

Patent Abstracts of Japan, Publication No. JP418901, "Rare Earth Iron Based Permanent Magnet and its Manufacture," Jul. 1, 1992.

Patent Abstracts of Japan, Publication No. JP61214402, "Manufacture of Sintered Magnet," Sep. 24, 1986.

Patent Abstracts of Japan, Publication No. JP4116144, "Permanent Magnet Alloy of R–Fe–Co–B–C System which is Small in Irreversible Demagnetization and Excellent in Thermal Stability," Apr. 16, 1992.

Patent Abstracts of Japan, Publication No. JP1208813, "Manufacture of Rare Earth Magnet," Aug. 22, 1989.

A. S. Kim, "Effect of oxygen on magnetic properties of Nd–Fe–B magnets," J. Appl. Phys., vol. 64, No. 10. pp. 5571–5573, 1988.

A. S. Kim, "Magnetic properties of NdDyFeCoAlb alloys, "J. Appl. Phys., vol. 63, No. 8, pp. 3975–3977, 1988.

Yoshikawa et al., "Effect of additive elements on magnetic properties and irreversible loss of hot–worked Nd–Fe–Co–B magnets," J. Appl. Phys., vol. 69, No. 8, pp. 6049–6051, 1991.

Shimoda et al., "High–energy cast Pr–Fe–B magnets," J. Appl. Phys., vol. 64, No. 10, pp. 5290–5292, 1988.

Sakamoto et al., "Cu–added Nd–Fe–B anisotropic powder for permanent magnet use," J. Appl. Phys., vol. 69, No. 8, pp. 5832–5834, 1988.

Tonkunaga et al., "Improvement of thermal stability of Nd–Dy–Fe–Co–B sintered magnets by additions of Al, Nb and Ga," IEEE Transactions on Magnetics, vol. MAG–23, No. 5, pp. 2287–2289, 1987.

*Primary Examiner*—George Wyszomierski

*Attorney, Agent, or Firm*—Finnegan, Henderson, Farabow, Garrett & Dunner, L.L.P.

[57] ABSTRACT

A permanent magnet alloy and method for production thereof. The permanent magnet alloy has a rare earth element including Nd, B, Fe, C, and oxygen, with additions of Co and at least one of Cu, Ga and Ag. The alloy may be produced by contacting particles thereof with carbon- and oxygen-containing material to achieve desired carbon and oxygen contents.

8 Claims, 9 Drawing Sheets

RE-FE-B MAGNETS AND MANUFACTURING METHOD FOR THE SAME

This is a division of application Ser. No. 08/235,279, filed Apr. 29, 1994, now U.S. Pat. No. 5,480,471.

BACKGROUND OF THE INVENTION

1. Field of the Invention

The invention relates to a permanent magnet alloy for use in the production of permanent magnets.

2. Description of the Prior Art

Permanent magnet alloys, and magnets produced therefrom, are conventionally produced by combining a light rare earth element, preferably neodymium, with the transition element iron, and boron. Permanent magnets produced from these alloys exhibit outstanding magnetic properties at room temperature. The alloys, however, exhibit poor thermal stability and poor corrosion resistance, particularly in humid environments. Hence, this limits the applications for which permanent magnets of these alloy compositions may be used. Various alloy modifications have been proposed to overcome the problems of poor thermal stability and poor corrosion resistance. None of these modifications have resulted in improving these properties without sacrificing other significant properties.

OBJECTS OF THE INVENTION

It is accordingly a primary object of the present invention to provide a permanent magnet alloy and method for producing the same having improved thermal stability and corrosion resistance.

Another object of the invention is to provide a permanent magnet alloy and method for producing the same wherein improved stability and corrosion resistance is achieved, while improving the intrinsic coercivity without decreasing the remanence and Curie temperature to expand the useful temperature range for magnets made from the alloy.

SUMMARY OF THE INVENTION

In accordance with the invention, a permanent magnet alloy is provided consisting essentially of, in weight percent, 27 to 35, preferably 29 to 34 of a rare earth element, including Nd in an amount of at least 50% of the total amount of the rare earth element content, 0.8 to 1.3, preferably 0.9 to 1.2 B, up to 30, preferably 15 Co, 40 to 75 Fe, 0.03 to 0.3, preferably 0.05 to 0.15 C, 0.2 to 0.8, preferably 0.3 to 0.8 oxygen, up to 1, and preferably 0.5 of at least one of Cu, Ga and Ag. The alloy can further include up to 5 of at least one additional transition element selected from the group consisting of Al, Si, Sn, Zn, Nb, Mo, V, W, Cr, Zr, Hf, Ti, and Mg.

Cu, Ga and Ag may be present within the range of 0.02 to 0.5%, preferably 0.05 to 0.5%.

At least one of Pr or La may be substituted for up to 50% of the Nd. Likewise, at least one of Dy or Tb may be substituted for up to 50% of the Nd.

Co may be present within the range of 0.5 to 5%. Cu may be present within the range of 0.02 to 0.5%.

In accordance with the method of the invention, the above permanent magnet alloy is produced from prealloyed particles and/or blends of prealloyed particles. This may be achieved by the conventional practice of comminuting a casting of the alloy or atomization of the molten alloy as by the use of an inert atomizing gas in accordance with this well known practice. The prealloyed particles or blends thereof are contacted with a carbon containing material to produce a carbon content therein of 0.03 to 0.3% and preferably 0.05 to 0.15%. The carbon containing material may be a metal stearate, preferably zinc stearate. After contact with the zinc stearate, the size of the particles may be reduced by well known practices, such as jet milling. The particles are also contacted with an oxygen containing material to produce an oxygen content therein of 0.2 to 0.8% and preferably 0.3 to 0.8%. The oxygen containing material may be air. The particles may be contacted with air either during or after the size reduction thereof, including during a milling operation for reducing the size of the particles. The milling operation is preferably jet milling. The carbon-containing material and oxygen-containing material may be carbon dioxide.

DESCRIPTION OF THE PREFERRED EMBODIMENTS

For purposes of development and demonstration of the invention, various alloys were prepared by conventional powder metallurgy processing and tested. Specifically, the alloys were produced by vacuum induction melting of a prealloyed charge of high purity elements and master alloys to produce a molten mass of the selected alloy composition. The molten mass was poured into a copper book mold or alternately atomized to form prealloyed powders by the use of argon as the atomizing gas. The cast ingot or atomized powder was hydrided at 1 to 30 atmospheres. The cast ingot was then crushed and pulverized into coarse powder. The pulverized powder or atomized powder was then ground into fine powder by jet milling with an inert gas such as argon or nitrogen gas. The pulverized powder or atomized powder was blended with various amounts of zinc stearate prior to jet milling to control the carbon content thereof and improve the jet milling practice. Oxygen was added by slowly bleeding air into the system either during or after jet milling. The oxygen and carbon may also be added and controlled by exposing the powder to a $CO_2$ environment incident to these operations. The average particle size of the milled powders was in the range of 1 to 5 microns, as measured by a Fisher Sub-Sieve Sizer.

The prealloyed powder, prepared as described above, was placed in a rubber bag, aligned in a magnetic field, and compacted by cold isostatic pressing. The pressed compacts were then sintered to approximately their theoretical (full) density in a vacuum furnace at a temperature within the range of 900° to 1100° C. for one to four hours. The sintered compacts were further heat treated at about 800° to 900° C. for one hour and then aged within the range of 450° to 750° C. These magnet compacts were then ground and sliced into cylindrical shapes (6 mm thick by 15 mm diameter) for testing.

The magnetic properties of the magnets tested were measured with a hysteresigraph equipped with a KJS Associate's temperature probe at temperatures between room temperature and 150° C. The irreversible loss was estimated by measuring the flux difference with a Helmholtz coil before and after exposing the magnet at elevated temperatures of up to 250° C. for one hour. The permeance coefficient was one (1) because the L/D was 0.4 (6/15).

Figure 1:
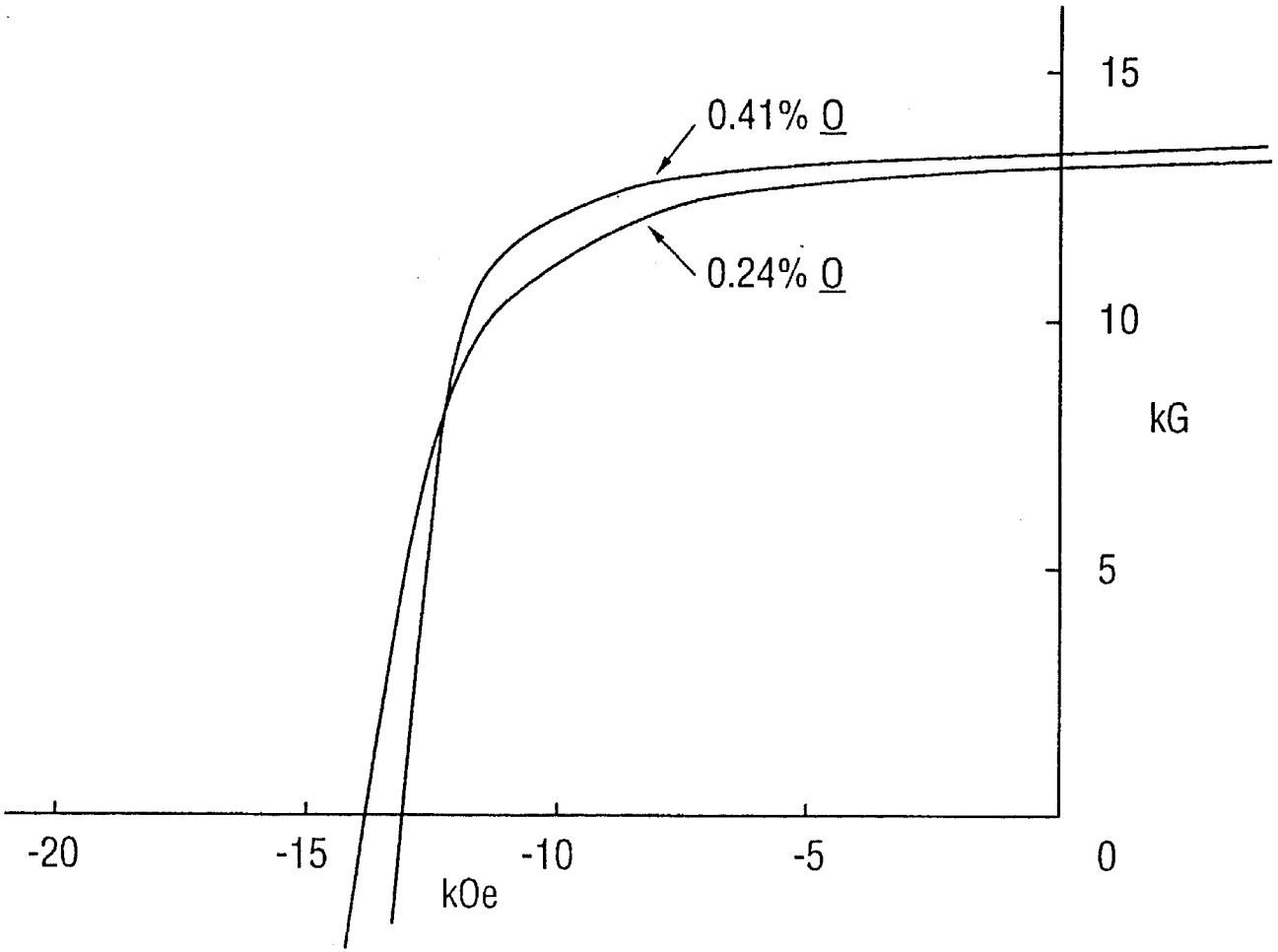
FIG. 1 is a graph showing the demagnetization curves of the alloy 32.5 Nd, 0.1 Dy, 1.0 B, 66.4 Fe with oxygen contents of 0.41 and 0.24%.
Figure 2:
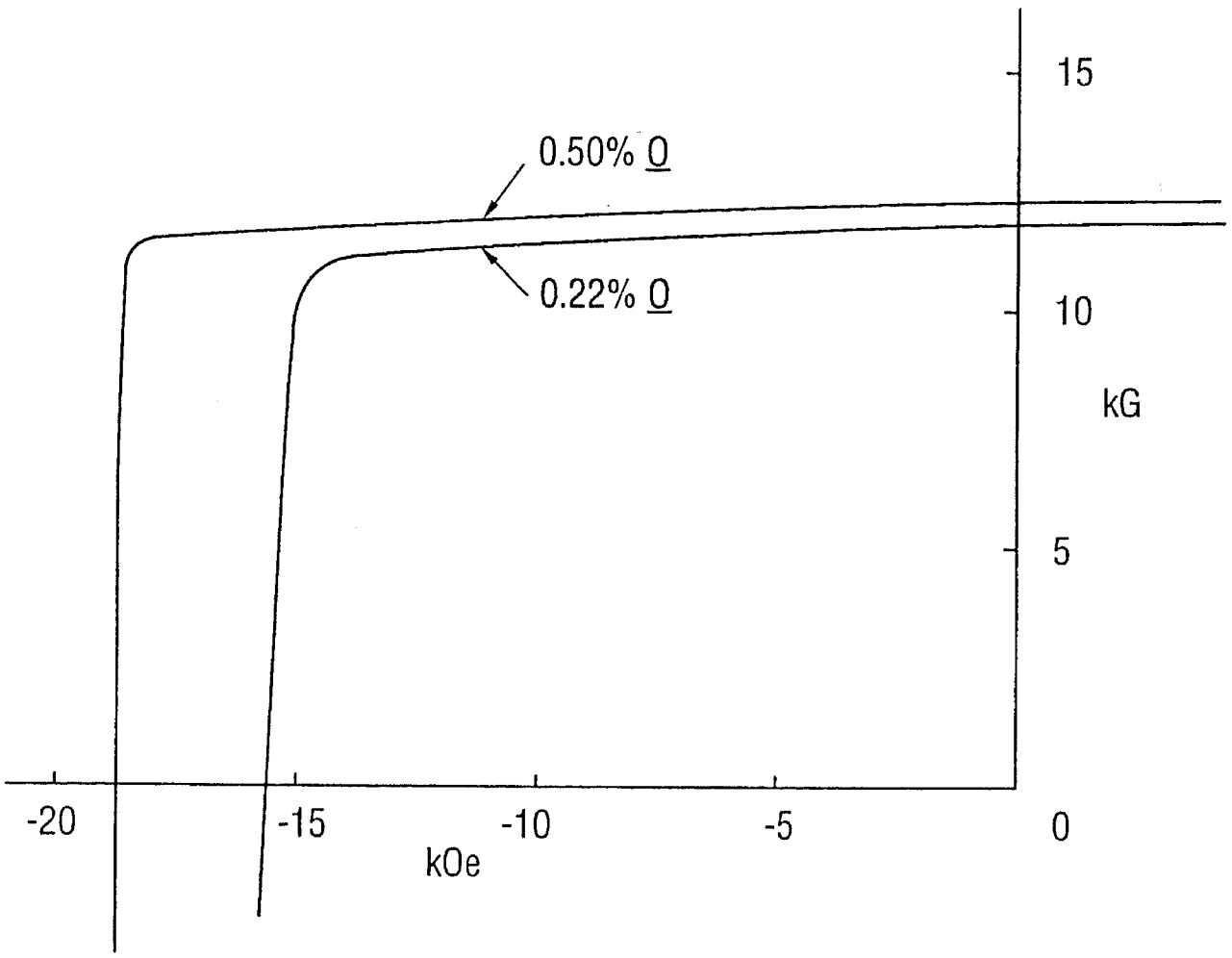
FIG. 2 is a graph similar to FIG. 1, showing demagnetization curves of a 30.5 Nd, 2.5 Dy, 62.6 Fe, 2.5 Co, 1.1 B, 0.15 Cu, 0.65 Nb, having oxygen contents of 0.22 and 0.55%.

As may be seen from and will be explained in detail with respect to the tables and drawings, it was discovered that the addition of oxygen to permanent magnet alloy compositions in accordance with the description and claims hereof decreases the coercivity, as shown in FIG. 1 with respect to the reported composition of (Nd,Dy)—Fe—B. When oxygen is added to a (Nd,Dy)—(Fe,Co)—B alloy, as shown in FIG. 2, it increases the coercivity, with the remanence in both cases being increased by an oxygen addition. The causes of the increases in remanence by oxygen addition in both of these alloys were investigated. The saturation magnetization values of the magnets of these alloys measured by VSM are the same both with and without oxygen addition. To assess the grain orientation of these magnets, an experiment was performed on the alloy (Nd,Dy)—(Fe,Co)—B. A ground surface normal to the cylinder axis was placed in a Bragg reflecting configuration in an X-ray powder diffractometer. The diffraction patterns with and without oxygen addition to the alloy were obtained. When the magnet is a single crystal, or had an ideal orientation with the easy axis normal to the surface, the diffraction pattern would show only reflections (001) with even values of 1, namely (004) and (006) in the investigated range. The results are shown in Table I.

TABLE I

REFLECTIONS WITH LOW (h, k) AND HIGH 1

| hkl | Intensity | Misorientation $(h^2 + k^2)l^2$ | Angle $\phi$, degree | $\cos\phi$ |
|---|---|---|---|---|
| 004 | 9 | 0 | 0 | 1 |
| 114 | 9 | 0.125 | 26.1 | 0.898 |
| 214 | 89 | 0.31 | 37.8 | 0.790 |
| 105 | 50 | 0.04 | 15.5 | 0.966 |
| 115 | 25 | 0.08 | 21.4 | 0.931 |
| 006 | 25 | 0 | 0 | 1 |
| 116 | 8 | 0.055 | 18.1 | 0.951 |

The reduction of magnetization through misorientation is described by cosø, which is given by $$\cos^2\phi = 1^2/[(c/a)^2(h^2+k^2)+1^2]$$

It was observed that sample A (without oxygen addition) exhibits strong (105) and (214) and relatively weak (004) and (006) peaks, while sample B (with oxygen addition) exhibits smaller (105), very weak (214), strong (004) and (006) peaks. This indicates that oxygen addition improves the grain orientation. Therefore, magnets with oxygen addition exhibit higher remanence than magnets without oxygen addition.

Figure 3:
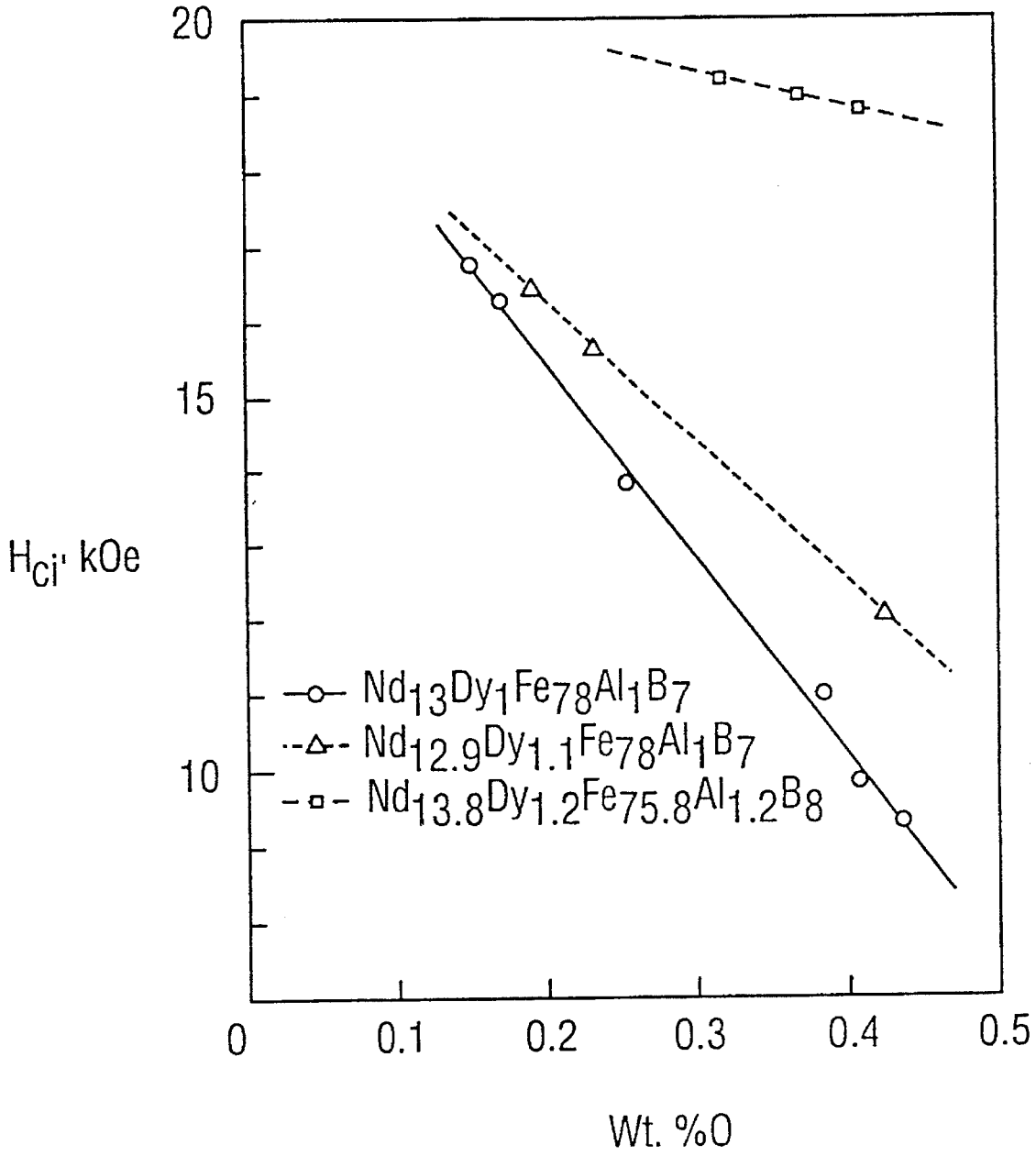
FIG. 3 is a graph indicating the variation in $H_{ci}$ for alloys of Nd—Dy—Fe—Al—B as a function of the oxygen content of the alloys.

The effect of variation in oxygen content on the coercivity of both types of alloys was also investigated. FIG. 3 shows the variation of coercivity for (Nd,Dy)—Fe—Al—B alloys, as a function of oxygen content. In this alloy system, the coercivity almost linearly decreases as the oxygen content increases. When the total rare earth content is lower, the $H_{ci}$ decreases more rapidly.

Figure 4:
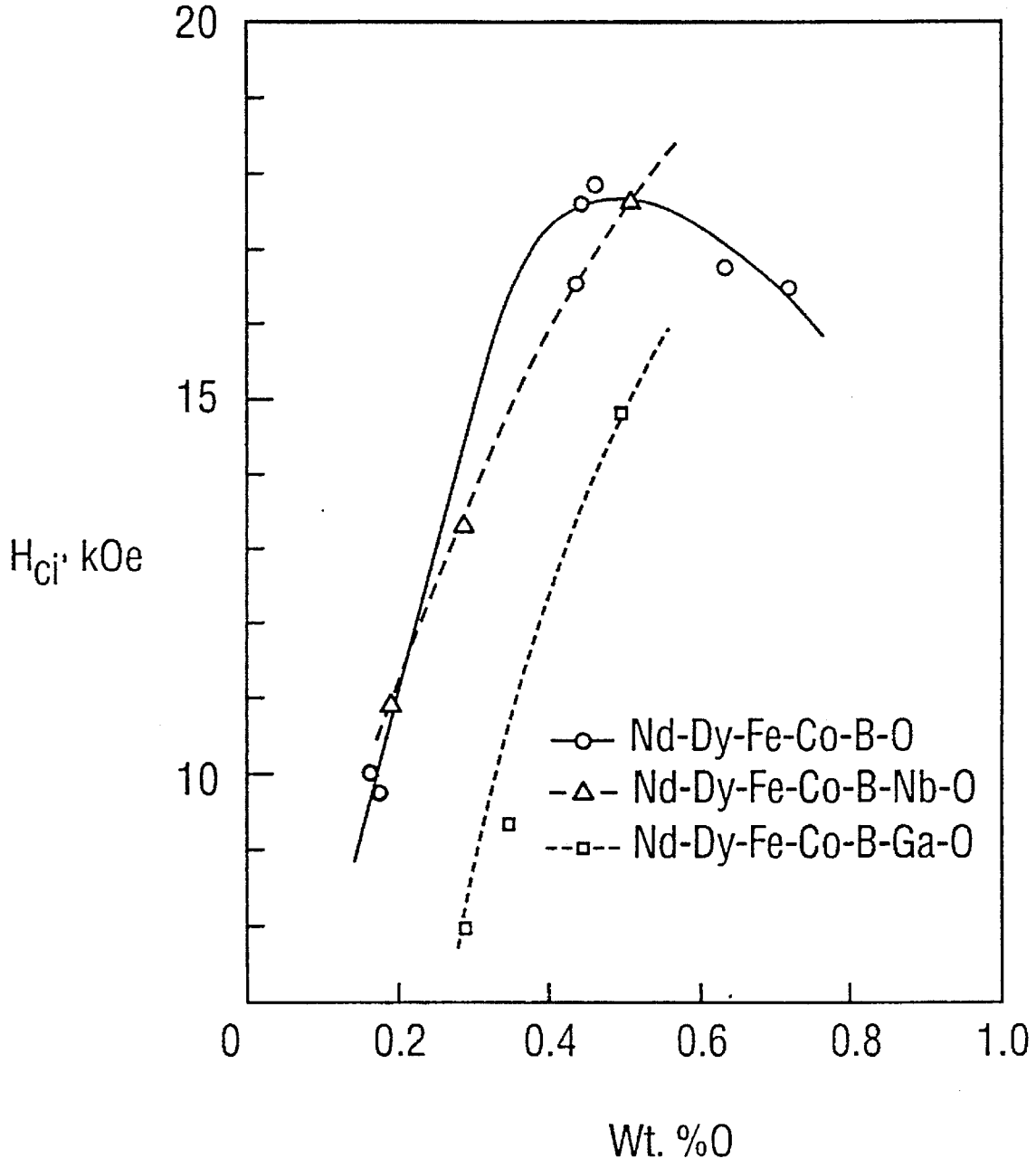
FIG. 4 is a graph similar to FIG. 3, indicating the variation in $H_{ci}$ for an alloy containing 29 Nd, 4 Dy, 5 Co, 1.15 B and balance Fe as a function of varying the oxygen content of the alloys.

FIG. 4 shows the variation of coercivity for cobalt containing alloys, (Nd,Dy)—(Fe,Co)—Al—B, as a function of oxygen content. In cobalt containing alloys, the coercivity initially rapidly increases as oxygen content increases up to a point depending on total rare earth and other additive elements, and then starts to decrease with further increases in oxygen content. Because of this positive effect of oxygen addition in (Nd,Dy)—(Fe,Co)—B alloys, the negative effect of a Co addition reducing the coercivity will be diminished or minimized by the simultaneous addition of Co and oxygen. Therefore, a high $T_c$ and $B_r$ magnet with improved $H_{ci}$ can be produced by the simultaneous addition of Co and oxygen in (Nd,Dy)—Fe—B alloys.

Figure 5:
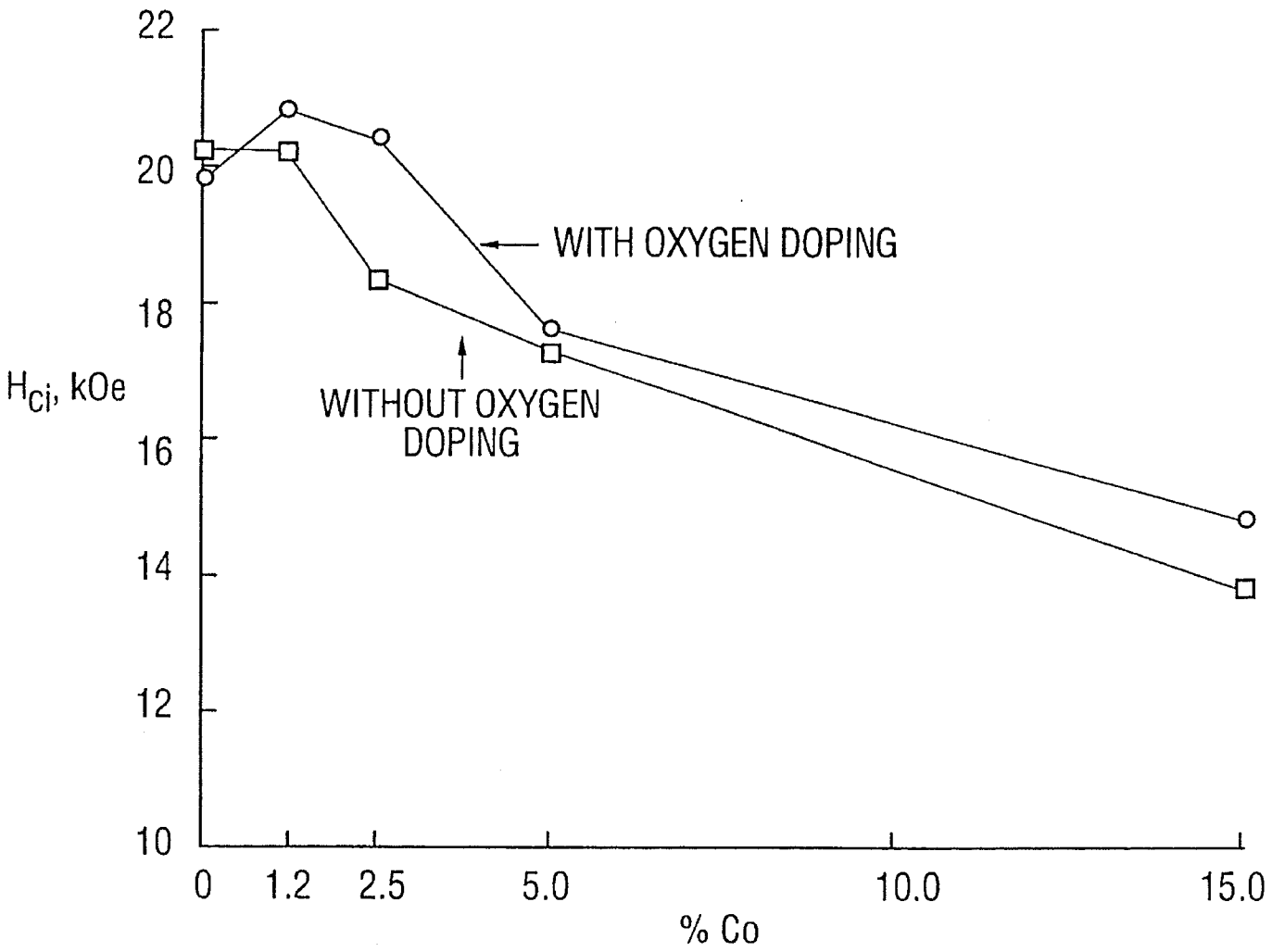
FIG. 5 is a graph showing the effect of varying Co with and without oxygen addition for an alloy of 30.5 Nd, 2.5 Dy, 1.1 B, 0.15 Cu, 0.65 Nb, and balance iron.

The effects of Co variation in a (Nd,Dy)—(Fe,Co)—B alloy were investigated with and without oxygen addition, and the results are listed in Table II. The variation of coercivities of the alloys with and without oxygen addition are plotted against cobalt content in FIG. 5.

TABLE II

THE EFFECT OF Co VARIATIÓN IN A 30.5Nd-2.5Dy-BAL Fe-1.1B-0.15Cu-0.65Nb-xCo ALLOY WITH AND WITHOUT OXYGEN DOPING

| | ~0.2% $O_2$ | | ~0.45% $O_2$ | |
|---|---|---|---|---|
| % Co | $B_r$, kG | $H_{ci}$, kOe | $B_r$, kG | $H_{ci}$, kOe |
| 0 | 11.30 | 20.2 | 11.65 | 19.8 |
| 1.2 | 11.45 | 20.2 | 11.65 | 20.8 |
| 2.5 | 11.20 | 18.3 | 11.30 | 20.4 |
| 5.0 | 11.40 | 17.3 | 11.50 | 17.6 |
| 15.0 | 11.45 | 13.9 | 11.55 | 14.9 |

As shown in Table II, the remanence increases 100–350 Gauss by oxygen addition to these alloys. The coercivity of non-cobalt containing alloys slightly decreases with oxygen addition, while that of cobalt containing alloys somewhat increases with oxygen addition. In alloys without oxygen addition, the coercivity decreases as cobalt content increases. In alloys with oxygen addition, the coercivity initially increases as Co content increases from zero to 1.2%, and then starts to decrease with further increases in Co content. Therefore, simultaneous addition of oxygen and a small amount of Co (1.2–2.5%) improves both remanence and coercivity. Even at higher Co contents, the coercivities of oxygen doped alloys are still higher than those of the alloys Without oxygen addition. Therefore, oxygen addition is essential for Co containing (Nd,Dy)—(Fe,Co)—B alloys. Since the $T_c$ almost linearly increases with Co content, the required Co content in the alloy depends on Curie temperature, temperature stability and temperature coefficient of $B_r$. Generally, the Co content is preferred to be between 0.5 and 5%.

TABLE III

CHEMICAL COMPOSITIONS OF ALLOYS A, B, AND C BY WT. %

| Alloy | Nd | Dy | Fe | Co | B | Cu | Nb | Al |
|---|---|---|---|---|---|---|---|---|
| (A) | 31.5 | 0.5 | bal | 1.2 | 1.0 | 0.15 | — | — |
| (B) | 30.5 | 2.5 | bal | 1.2 | 1.1 | 0.15 | 0.35 | — |
| (C) | 28.0 | 6.0 | bal | 2.5 | 1.1 | 0.15 | 0.65 | 0.3 |

A few examples of improved magnetic properties and temperature stability (irreversible loss at elevated temperature) by oxygen addition are listed in Table IV. The chemical compositions of examined alloys are listed in Table III.

TABLE IV

MAGNETIC PROPERTIES AND IRREVERSIBLE TEMPERATURE LOSS OF VARIOUS ALLOYS WITH AND WITHOUT OXYGEN DOPING

| Alloy | % $O_2$ | $B_r$ kG | $H_{ci}$ kOe | $BH_{max}$ MGOe | % Irr. Loss P.C. = 1.0 |
|---|---|---|---|---|---|
| (A) | 0.237 | 12.7 | 11.2 | 38.2 | 39.0% at 150° C. |
| | 0.574 | 12.9 | 14.9 | 40.2 | 3.6% at 150° C. |
| (B) | 0.123 | 11.7 | 16.8 | 33.2 | 20.8% at 175° C. |
| | 0.495 | 12.1 | 20.0 | 35.3 | 0.3% at 175° C. |
| (C) | 0.253 | 10.6 | >20.0 (9.7 at 150° C.) | 27.5 | 8.3% at 200° C. |
| | 0.558 | 10.9 | >20.0 (11.3 at 150° C.) | 29.3 | 1.8% at 200° C. |

As shown in Table IV, the magnetic properties (both $B_r$ and $H_{ci}$) and temperature stability (irreversible loss) are substantially improved by an oxygen addition to Co containing (Nd,Dy)—(Fe,Co)—B magnets.

It is noted, however, that the coercivity starts to decrease when oxygen exceeds about 0.8% depending on the additive elements as shown in FIG. 4. It is, therefore, necessary to limit oxygen content to between 0.2 and 0.8%, preferably 0.3 to 0.8%.

Since the magnets of the present invention were made by blending alloys with zinc stearate prior to jet milling, it is necessary to study the effect of variations of zinc stearate (carbon) on the magnetic properties. An alloy, 31.9Nd—63.2Fe—3.6Co—1.15B—0.15Cu, was made by argon gas atomization. After hydriding, the powder was blended with different amounts of zinc stearate prior to jet milling as shown in Table V. The magnetic properties ($B_r$ and $H_{ci}$) are plotted against zinc stearate variation in FIG. 6. The variation of carbon content in the sintered magnets, density, remanence, and coercivity are also listed as a function of zinc stearate in Table V.

TABLE V

THE EFFECT OF ZINC STEARATE ADDITION TO 31.9Nd-63.2Fe-3.6Co-1.15B-0.15Cu ALLOYS

| % ZS | % C | D g/cc | $B_r$ kG | $H_{ci}$ kOe |
|---|---|---|---|---|
| 0 | 0.036 | 7.39 | 12.2 | 9.6 |
| 0.05 | 0.073 | 7.57 | 12.7 | 12.3 |
| 0.1 | 0.094 | 7.53 | 13.0 | 12.15 |

TABLE V-continued

THE EFFECT OF ZINC STEARATE ADDITION TO 31.9Nd-63.2Fe-3.6Co-1.15B-0.15Cu ALLOYS

| % ZS | % C | D g/cc | $B_r$ kG | $H_{ci}$ kOe |
|---|---|---|---|---|
| 0.2 | 0.150 | 7.56 | 13.2 | 11.1 |
| 0.3 | 0.184 | 7.57 | 13.25 | 9.3 |
| 0.5 | 0.310 | 7.56 | 13.5 | 7.7 |
| 0.8 | — | | not densified | |

Figure 6:
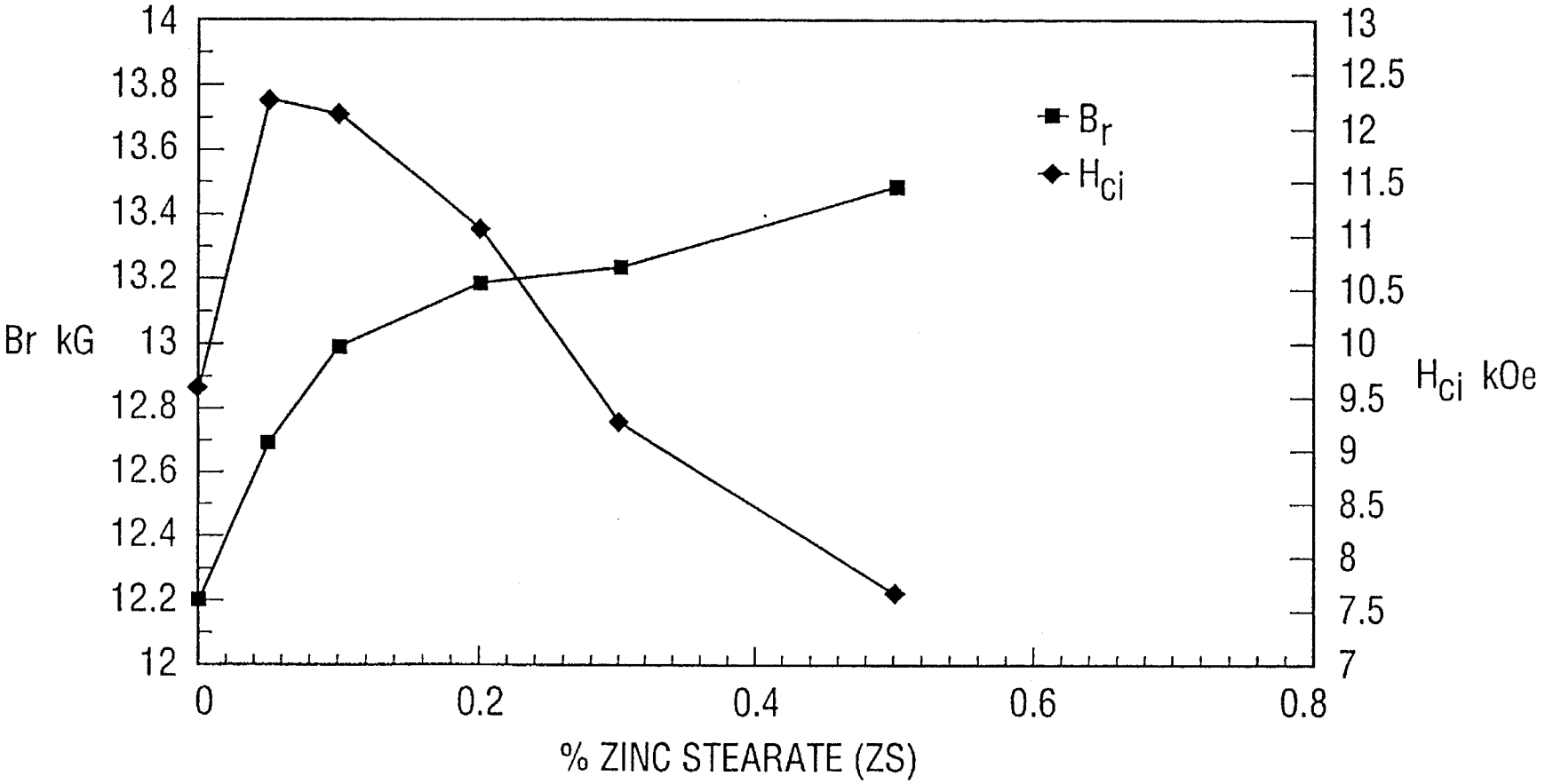
FIG. 6 is a graph showing the effect of zinc stearate addition in varying amounts to increase the carbon content of an alloy of 31.9 Nd, 63.2 Fe, 3.6 Co, 1.15 B and 0.15 Cu.

As shown in FIG. 6, both the $B_r$ and $H_{ci}$ have significantly increased with small additions of zinc stearate. When the zinc stearate addition exceeds 0.1%, the $H_{ci}$ starts to decrease while the $B_r$ increases slowly. When the zinc stearate addition is 0.8%, the compact is not densified. Therefore, any zinc stearate employed for carbon addition should be limited to 0.5%. The carbon content of the sintered magnet almost linearly increases as the amount of zinc stearate added increases. Therefore, it is essential to add small amounts of zinc stearate (carbon) for improving magnetic properties (both $B_r$ and $H_{ci}$). The optimum range of zinc stearate addition is 0.05 to 0.2%, depending on the magnetic property requirements. In the following study, the zinc stearate addition was fixed at 0.1%, and oxygen was added to about 0.5% in Co containing alloys.

Figure 7:
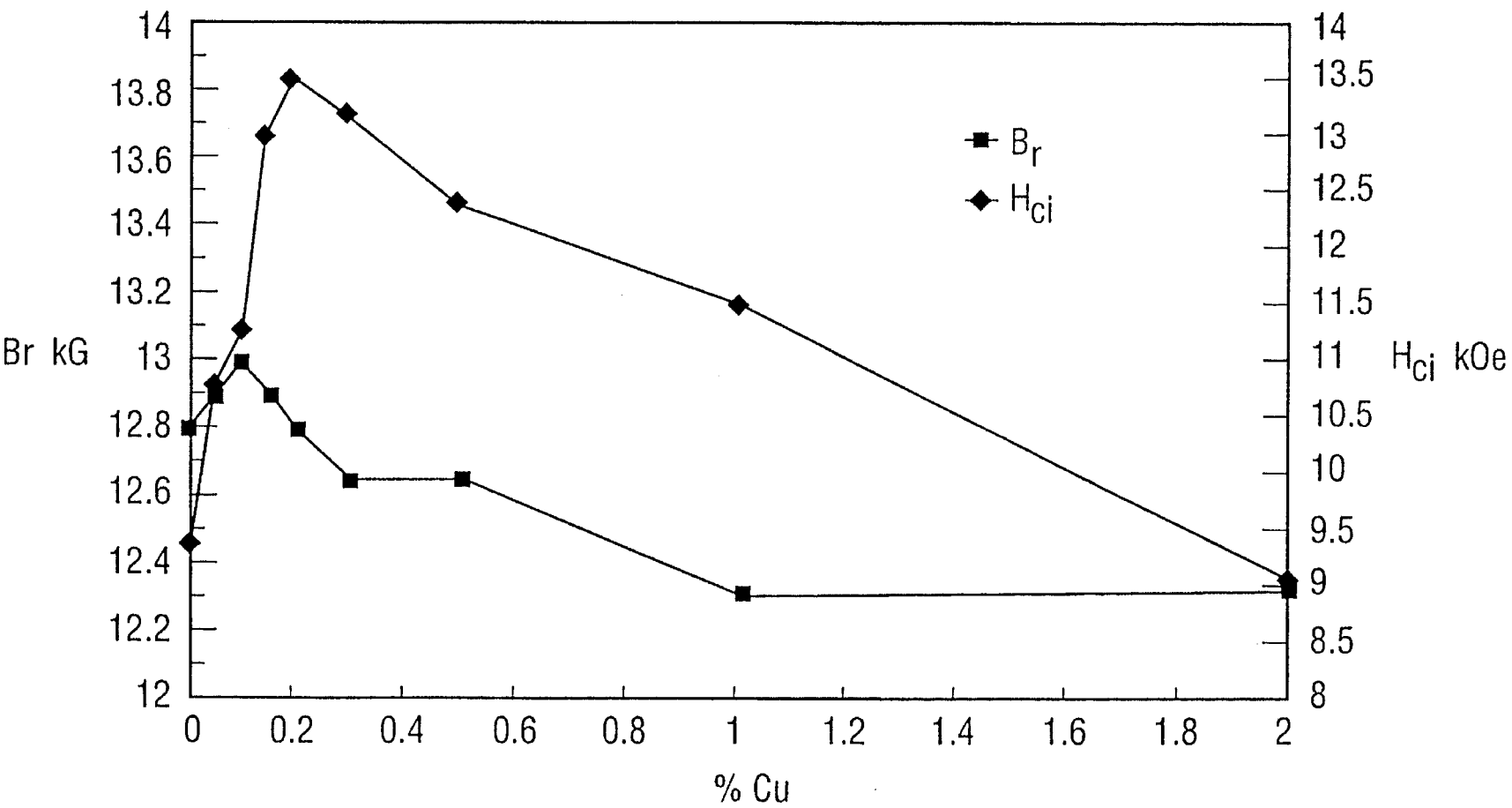
FIG. 7 is a graph showing the effect of varying the Cu content in an alloy of 33 Nd, 5 Co, 1.1 B, and balance iron.

Since it is known that the addition of 1 to 2% copper to NdFeB melt spun ribbon substantially increased the coercivity, we examined the effect of Cu variation in sintered (Nd,Dy)—(Fe,Co)—B alloys. FIG. 7 and Table VI exhibit the variations of $B_r$ and $H_{ci}$ plotted against Cu variation in a 33Nd—1.1B—5Co—(60.9–x)Fe—xCu alloy, and corrosion resistance as a function of weight loss in relation to the Cu content.

TABLE VI

THE EFFECT OF Cu VARIATION IN A 33Nd-1.1B-5.0Co-(60.9-x)Fe-xCu ALLOY

| % Cu | D g/cc | $B_r$ kG | $H_{ci}$ kOe | Wt. Loss ($mg/cm^2$) 96 hr | 240 hr |
|---|---|---|---|---|---|
| 0 | 7.58 | 12.8 | 9.4 | 17.5 | 228 |
| 0.05 | 7.58 | 12.9 | 10.8 | 0.5 | 4.7 |
| 0.1 | 7.58 | 13.0 | 11.3 | 0.7 | 2.2 |
| 0.15 | 7.58 | 12.9 | 13.0 | 0.07 | 0.08 |
| 0.2 | 7.58 | 12.8 | 13.5 | 0.01 | 0.16 |
| 0.3 | 7.58 | 12.65 | 13.2 | 0.05 | 0.42 |
| 0.5 | 7.57 | 12.65 | 12.4 | 0.15 | 0.25 |
| 1.0 | 7.48 | 12.3 | 11.5 | 0.19 | 0.36 |
| 2.0 | 7.36 | 12.3 | 9.0 | 0.52 | 0.76 |

As the copper content increases to 0.15%, the $H_{ci}$ increases rapidly and reaches its maximum at 0.2% Cu. When the copper content exceeds 0.2%, the $H_{ci}$ starts to decrease. The $B_r$ also increases slightly as the copper content increases to 0.1%, and then slowly decreases with further increases in copper content. Therefore, the overall change in remanence is negligible in the range of between 0 to 0.2% copper. A small addition of copper to Nd—Fe—B does not change the Curie temperature. These data indicate that a small addition of copper (up to 0.2%) to Nd—Fe—Co—B alloys substantially improves $H_{ci}$ without reduction of $B_r$ or $T_c$. The corrosion rate is significantly reduced as the copper content increases from 0 to 0.15% and the minimum corrosion rate is maintained with further increases in copper content.

Figure 8:
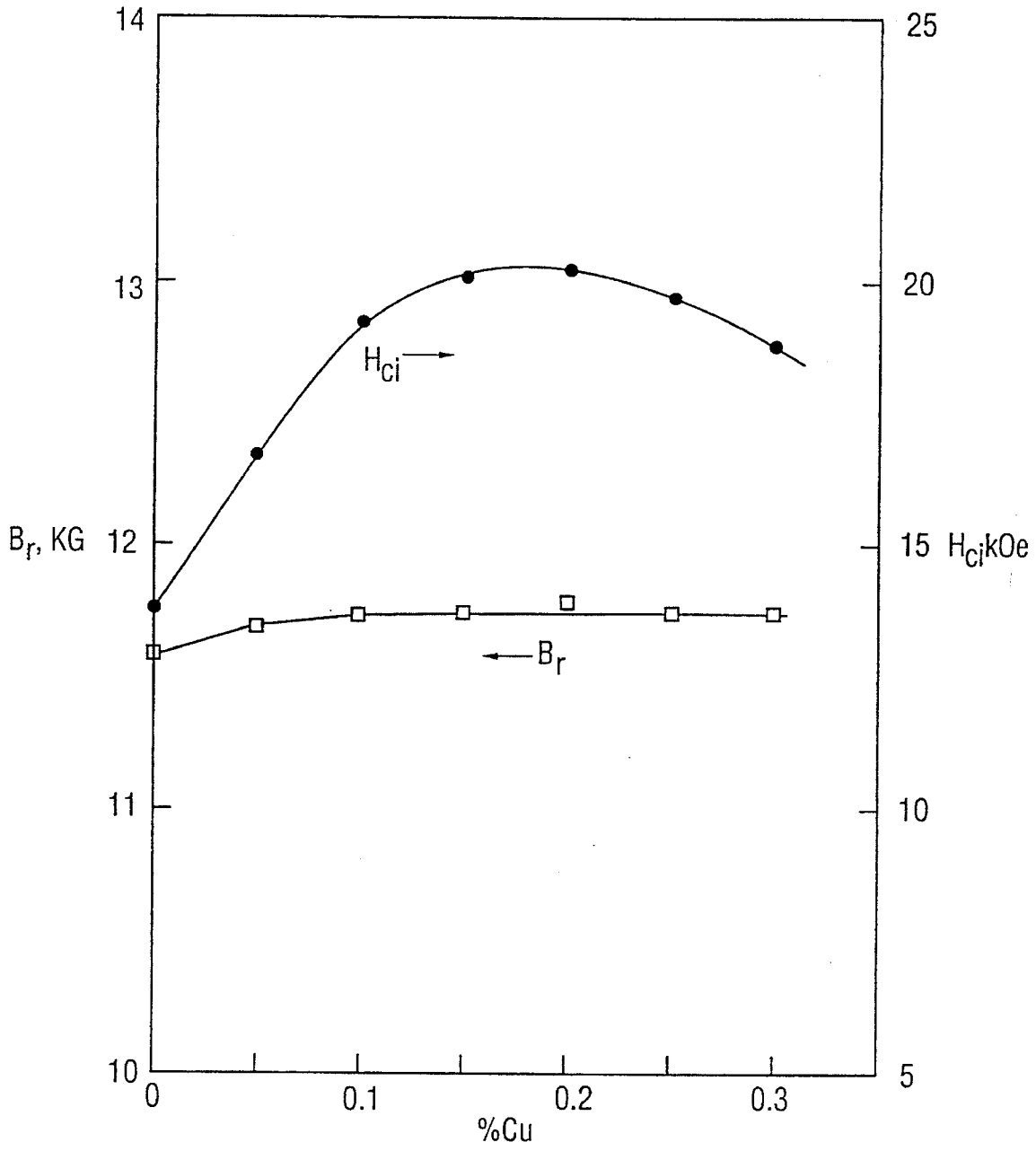
FIG. 8 is a graph showing the variation in the magnetic properties as a function of varying the copper content in an alloy of 30.5 Nd, 2.5 Dy, 1.2 Co, 1.1 B, 0.5 Nb, and balance iron.

Another set of magnets was made with oxygen doping to approximately 0.5%. FIG. 8 and Table VII exhibit the variation of magnetic properties as a function of Cu content in 30.5Nd—2.5Dy—bal Fe—1.2Co—1.1B—0.5Nb—xCu alloy.

TABLE VII

THE EFFECT OF Cu VARIATION IN A 30.5Nd-2.5Dy-BAL Fe-1.2Co-1.1B-0.5Nb-xCu ALLOY

| % CU | $B_R$ | $H_{ci}$ | $BH_{max}$ |
|---|---|---|---|
| 0 | 11.6 | 13.8 | 32.0 |
| 0.05 | 11.7 | 16.8 | 33.0 |
| 0.1 | 11.75 | 19.3 | 33.5 |
| 0.15 | 11.75 | 20.2 | 33.5 |
| 0.2 | 11.8 | 20.4 | 33.8 |
| 0.25 | 11.75 | 19.8 | 33.5 |
| 0.3 | 11.75 | 19.3 | 33.5 |

As the copper content increases to 0.1%, the $H_{ci}$ increases rapidly then slowly increases to a maximum at 0.2% Cu. When the copper content exceeds 0.2%, the $H_{ci}$ starts to decrease. The remanence and energy products also increase slightly as the copper content increases to 0.1%, and then remain the same with further increases in copper content to 0.3%. This indicates that a small addition of copper (between 0.1 and 0.3%) to oxygen doped (Nd,Dy)—(Fe, Co)—B alloys substantially increases $H_{ci}$ with slight increases in $B_r$ and $(BH)_{max}$. It is, therefore, beneficial to simultaneously add small amounts of Cu, O, C (zinc stearate) to Co containing (Nd,Dy)—(Fe,Co)—B magnets in order to effectively improve coercivity without sacrifice of remanence.

It was observed that small additions of Ga or Ag to Co containing (Nd,Dy)—(Fe,Co)—B magnets might also substantially increase the coercivity similar to Cu. Examples of improved magnetic properties ($H_{ci}$) resulting from small additions of Cu, Ga, or Ag are listed in Table VIII.

TABLE VIII

CHEMICAL COMPOSITION AND MAGNETIC PROPERTIES

| | Chemical Composition (Wt. %) | | | | | | | | $B_r$ | $H_{ci}$ |
|---|---|---|---|---|---|---|---|---|---|---|
| Alloy | Nd | Dy | Fe | Co | B | Cu | Ag | Ga | kG | kOe |
| D | 31.9 | — | bal | 3.6 | 1.15 | — | — | — | 12.8 | 10.2 |
| E | 31.9 | — | bal | 3.6 | 1.15 | 0.15 | — | — | 12.9 | 13.0 |
| F | 31.9 | — | bal | 3.6 | 1.15 | — | 0.2 | — | 12.9 | 13.2 |
| A | 31.5 | 0.5 | bal | 1.2 | 1.0 | 0.15 | — | — | 12.8 | 15.2 |
| G | 31.5 | 0.5 | bal | 1.2 | 1.0 | — | — | 0.4 | 12.8 | 15.3 |

As shown in Table VIII, the coercivities are substantially increased by small additions (0.1 to 0.4 wt. %) of Cu, Ag, or Ga to Co containing alloys (Nd,Dy)—(Fe,Co)—B, without reduction of remanence.

The effect of combined additions of these elements, Cu, Ga, and Ag, was also investigated. Alloys A (0.15% Cu) and G (0.4% Ga) were blended in different ratios, as shown in Table IX.

TABLE IX

THE EFFECT OF Ga AND Cu VARIATION IN A 31.5Nd-0.5Dy-BAL Fe-1.2Co-1.0B-xGa-yCu ALLOY

| % Ga | % Cu | D g/cc | $B_r$, RT kG | $H_{ci}$, RT kOe |
|---|---|---|---|---|
| 0 | 0.15 | 7.60 | 12.8 | 15.2 |
| 0.1 | 0.117 | 7.56 | 12.6 | 15.8 |

TABLE IX-continued

THE EFFECT OF Ga AND Cu VARIATION IN A 31.5Nd-0.5Dy-BAL Fe-1.2Co-1.0B-xGa-yCu ALLOY

| % Ga | % Cu | D g/cc | $B_r$, RT kG | $H_{ci}$, RT kOe |
|---|---|---|---|---|
| 0.2 | 0.075 | 7.57 | 12.8 | 16.4 |
| 0.3 | 0.038 | 7.59 | 12.9 | 16.6 |
| 0.4 | 0 | 7.57 | 12.8 | 15.3 |

Although both alloys exhibit similar magnetic properties individually, when blended together the blended alloys exhibit higher coercivities. This indicates that when both elements Cu and Ga are used together, they effectively increase coercivity. The maximum coercivity was obtained when Ga content is 0.3% and Cu is 0.038%.

This concept was applied to 9% dysprosium alloys. By fixing copper content at 0.2, the Ga content was varied from 0 to 1.0%. The coercivities of these magnets were measured at 150° C.

TABLE X

THE EFFECT OF Ga VARIATION IN A 24Nd-9Dy-BAL Fe-2Co-1.1B-0.2Cu-0.65Nb-0.3Al-xGa ALLOY

| % Ga | D g/cc | $B_r$, RT kG | $H_{ci}$, 150° C. kOe | Irr. Loss at 250° C. (%) PC = 1.0 |
|---|---|---|---|---|
| 0 | 7.54 | 10.1 | 15.7 | 16.1 |
| 0.2 | 7.53 | 10.2 | 16.5 | 2.0 |
| 0.4 | 7.47 | 10.05 | 16.9 | 3.1 |
| 0.6 | 7.42 | 10.0 | 16.3 | 2.9 |
| 0.8 | 7.33 | 9.9 | 15.9 | 4.4 |
| 1.0 | 7.31 | 9.5 | 15.3 | 9.0 |

As shown in Table X, the coercivity at 150° C. increases as Ga content increases to 0.4%, and then starts to decrease with further increases in Ga content. The maximum coercivity was obtained when the Ga content is 0.4% and the Cu content is 0.2%. The irreversible losses at 250° C. are very low when Ga content is between 0.2 and 0.6%, while magnets without Ga or with 1.0% Ga exhibit relatively large irreversible losses. As the Ga content increases, the density starts to decrease. These data indicate that the optimum Ga content required for temperature stable magnets in this alloy system is between 0.2 and 0.6%. This is much lower than the Ga content necessary in (Nd,Dy)—(Fe,Co)—B alloys without O, C, and Cu addition if the same coercivity and temperature stability are required.

It is known to add 1 to 2 at. % (1.05–2.1 wt. %) Ga for similar enhancements. Therefore, single or combined additions of small amounts of M1 (Cu, Ga, or Ag) to the (Nd,Dy)—(Fe,Co)—(B,C,O) alloy effectively improve the coercivity without remanence reduction.

Figure 9:
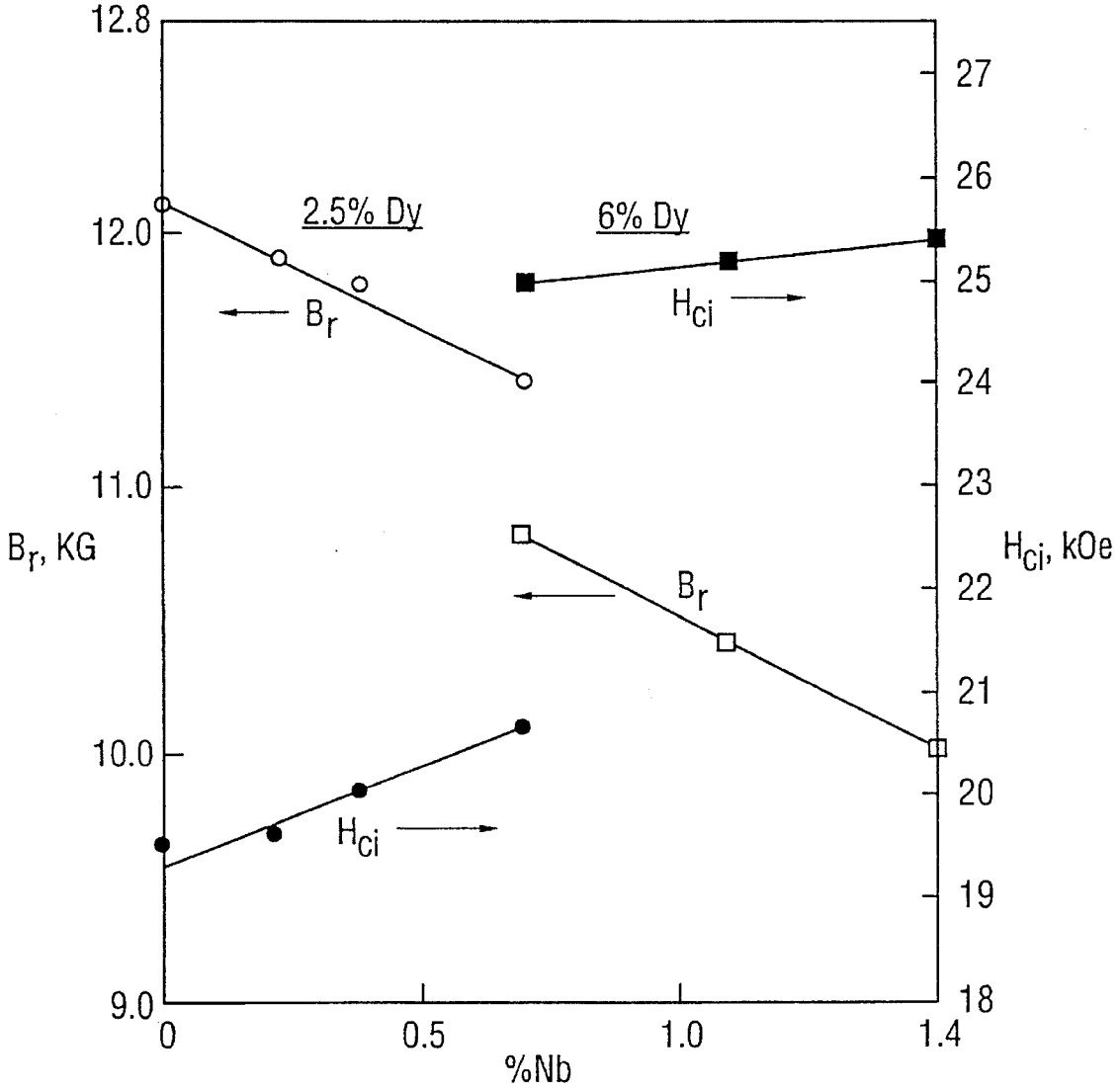
FIG. 9 is a graph showing the variation of magnetic properties as a function of varying the Nb content of the alloys 30.5 Nd, 2.5 Dy, 1.2 Co, 0.15 Cu, 1.1 B, and balance iron, and 28 Nd, 6 Dy, 2.5 Co, 1.1 B, 0.15 Cu, and balance iron.

Additions of other transition metals (M2) including Al, Si, Sn, Zn, Nb, Mo, V, W, Cr, Zr, Hf, Ti, Mg, etc. to this alloy system, (Nd,Dy)—(Fe,Co,M1)—(B,C,O), further improve the coercivity with some reduction of remanence. As shown in FIG. 9, for example, the $H_{ci}$ increases and the $B_r$ decreases as Nb content increases. Table XI displays magnetic properties of these alloys with various transition metals (M2) added.

TABLE XI

EFFECT OF M2 ELEMENTS ADDED IN (Nd, Dy)-(Fe, Co, Cu)-(B, C, O) ALLOYS

| | Wt. % | | | | | | | $B_r$ | $H_{ci}$ |
|---|---|---|---|---|---|---|---|---|---|
| Alloy | Nd | Dy | Fe | Co | B | Cu | M2 | kG | kOe |
| H | 30.5 | 2.5 | bal | 1.2 | 1.1 | 0.15 | — | 12.3 | 18.5 |
| I | 30.5 | 2.5 | bal | 1.2 | 1.1 | 0.15 | 0.2 Al | 12.0 | 20.4 |
| J | 30.5 | 2.5 | bal | 1.2 | 1.1 | 0.15 | 0.75 Si | 11.4 | 20.3 |
| K | 30.5 | 2.5 | bal | 1.2 | 1.1 | 0.15 | 0.65 Nb | 11.7 | 21.0 |
| L | 31.2 | 2.5 | bal | 1.2 | 1.1 | 0.15 | 0.2 Al + 0.65 Nb | 11.4 | 21.5 |

A part of Nd in this alloy system can be substituted by other light rare earth elements, including Pr, La. Table XII exhibits magnetic properties of this alloy system in which Nd is partially substituted by Pr or La.

TABLE XII

MAGNETIC PROPERTIES OF RE-(Fe, Co, Cu)-(B, O, C) ALLOYS WITH PARTIAL SUBSTITUTION OF Nd WITH OTHER RARE EARTH ELEMENTS

| | Wt. % | | | | | | | | | $B_r$ | $H_{ci}$ |
|---|---|---|---|---|---|---|---|---|---|---|---|
| Alloy | Nd | Pr | La | Dy | Fe | Co | B | Cu | Nb | kG | kOe |
| M | 30.5 | — | — | 2.5 | bal | 1.2 | 1.1 | 0.15 | 0.35 | 11.9 | 20.2 |
| N | 26.5 | 4.0 | — | 2.5 | bal | 1.2 | 1.1 | 0.15 | 0.35 | 12.0 | 20.1 |
| O | 28.8 | — | 1.6 | 2.5 | bal | 1.2 | 1.05 | 0.2 | — | 11.9 | 18.3 |

As may be seen from the above-reported specific examples, (Nd,Dy)—(Fe,Co)—B magnets doped with small amounts of oxygen and/or carbon, which may be achieved by zinc stearate addition, exhibit much higher magnetic properties (both $B_r$ and $H_{ci}$) than (Nd,Dy)—(Fe,Co)—B magnets without oxygen and/or carbon addition. Small additions of Cu, Ga, Ag, or a combination of these (M1) to (Nd,Dy)—(Fe,Co)—(B,C,O) substantially increases the coercivity without reduction of remanence. Since the coercivity is substantially improved without reduction of $T_c$ and/or $B_r$ in this alloy system, it can be used at elevated temperatures with minimum additions of Dy. Utilization of abundant and inexpensive elements such as O, C, Cu and reduction of expensive elements such as Dy and/or Ga will reduce the total cost of producing magnets from this alloy system. The coercivity can be further improved with additions of other transition metals (M2) including Al, Si, Sn, Zn, Nb, Mo, V, W, Cr, Zr, Hf, Ti, and Mg. Additions of these elements will, however, cause reduction of remanence and energy product. Other light rare earth elements such as Pr or La can partially replace Nd in this alloy system.

As used herein, all percentages are in "weight percent," unless otherwise indicated.

The following conventional abbreviations are used herein with respect to the reported properties of magnets:

$B_r$—remanence $H_{ci}$—intrinsic coercivity $BH_{max}$—energy product $T_c$—Curie temperature

What is claimed:

1. A permanent magnet alloy consisting essentially of, in weight percent, 27 to 35 of a rare earth element, including Nd in an amount of at least 50 percent of the total rare earth element content; 0.8 to 1.3 B; 0.5 to 5 Co; 40 to 75 Fe; 0.03 to 0.3 C; 0.2 to 0.8 oxygen; and 0.05 to 0.5 of at least one of Cu, Ga, and Ag, with said alloy exhibiting intrinsic coercivity of at least 10 kOe while maintaining substantially the same remanence and energy product compared to said alloy absent said Co and at least one of Cu, Ga, and Ag.

2. The permanent magnet alloy of claim 1, wherein at least one of Pr or La is substituted for up to 50 percent of the Nd.

3. The permanent magnet alloy of claim 1, wherein at least one of Dy or Tb is substituted for up to 50 percent of the Nd.

4. A permanent magnet alloy consisting essentially of, in weight percent, 27 to 35 of a rare earth element, including neodymium in an amount of at least 50 percent of the total rare earth element content; 0.8 to 1.3 B; 0.5 to 5 Co; 40 to 75 Fe; 0.03 to 0.3 C; 0.2 to 0.8 oxygen; and 0.05 to 0.5 Cu, with said alloy exhibiting intrinsic coercivity of at least 10 kOe while maintaining substantially the same remanence and energy product compared to said alloy absent said Co and Cu.

5. The permanent magnet alloy of claim 4, wherein at least one of Pr or La is substituted for up to 50 percent of the Nd.

6. The permanent magnet alloy of claim 4, wherein at least one of Dy or Tb is substituted for up to 50 percent of the Nd.

7. The permanent magnet alloy of claims 1 or 4, including up to 5 percent of at least one additional element selected from the group consisting of Al, Si, Sn, Zn, Nb, Mo, V, W, Cr, Zr, Hf, Ti, and Mg.

8. The permanent magnet alloy of claims 1 or 4, having 0.9 to 1.2 B, 0.05 to 0.15 C, and 0.3 to 0.8 oxygen.

* * * * *

US005589009C1

(12) EX PARTE REEXAMINATION CERTIFICATE (5732nd)

United States Patent

Kim et al.

(10) Number: US 5,589,009 C1

(45) Certificate Issued: Apr. 3, 2007

(54) RE-FE-B MAGNETS AND MANUFACTURING METHOD FOR THE SAME

(75) Inventors: Andrew S. Kim, Pittsburgh, PA (US); Floyd E. Camp, Trafford, PA (US)

(73) Assignee: Vacuumschmelze GmbH & Co. KG, Hanau (DE)

Reexamination Request:
No. 90/007,121, Jul. 19, 2004

Reexamination Certificate for:

| | |
|---|---|
| Patent No.: | **5,589,009** |
| Issued: | **Dec. 31, 1996** |
| Appl. No.: | **08/462,959** |
| Filed: | **Jun. 5, 1995** |

Related U.S. Application Data

(62) Division of application No. 08/235,279, filed on Apr. 29, 1994, now Pat. No. 5,480,471.

(51) Int. Cl.

| | |
|---|---|
| ***C22C 1/04*** | (2006.01) |
| ***H01F 1/57*** | (2006.01) |
| ***H01F 1/32*** | (2006.01) |

(52) U.S. Cl. ..... 148/302; 420/83; 420/121

(58) Field of Classification Search ..... None
See application file for complete search history.

(56) References Cited

U.S. PATENT DOCUMENTS

| | | | | |
|---|---|---|---|---|
| 4,770,723 | A | | 9/1988 | Sagawa et al. |
| 4,773,950 | A | | 9/1988 | Fujimura et al. |
| 4,859,255 | A | | 8/1989 | Fujimura et al. |
| 5,013,411 | A | * | 5/1991 | Minowa et al. ..... 205/119 |
| 5,125,990 | A | | 6/1992 | Iwasaki et al. |
| 5,181,973 | A | | 1/1993 | Hirose et al. |
| 5,411,608 | A | | 5/1995 | Hazelton et al. |

FOREIGN PATENT DOCUMENTS

| | | |
|---|---|---|
| EP | 0 106 948 B1 | 5/1984 |
| EP | 0 134 305 B2 | 3/1985 |
| EP | 9 134 394 B2 | 3/1985 |
| EP | 0430278 A1 | 6/1991 |
| JP | 4-007804 | 1/1992 |
| JP | 4-184901 | 7/1992 |
| JP | 6-124816 | 5/1994 |
| JP | 6-168808 | 6/1994 |

OTHER PUBLICATIONS

Bruzo, et al., 'Magnetic Properties of $R_2Fe_{14-x}Cu_xB$ Compounds with R=Nd OR Er,' *Journal of Magnetism and Magnetic Materials*, 86:97–101 (1990).

Chen, et al., 'Structural and magnetic properties of pseudoternary $Nd_2(Fe_{1-x}Cu_x)_{14}B$ compounds,' *J. Appl. Phys.*, 63(8):2739–2741 (1988).

Endoh, et al., 'Magnetic Properties and Thermal Stabilities of Ga Substituted Nd–Fe–Co–B Magnets,' *IEEE Trans. Mag.*, 23(5):2290–2292 (1987).

Kianvash, et al., 'Magnetic properties of the sintered magnets produced from a Nd–Fe–B–Cu–type material.' *J. Appl. Phys.*, 70(10):6453–6455 (1991).

Kim, et al., 'Effect of Oxygen, Carbon, and Nitrogen Contents on the Corrosion Resistance of Nd–Fe–B Magnets,' *IEEE Trans. Mag.*, 26(5):1936–1938 (1990).

Knoch, et al., 'Nd–Fe–B–based magnets: magnetic properties and microstructural appearance with copper addition,' *Journal of Alloys and Compounds*, 183:54–58 (1992).

Kou et al., 'Structure and Magnetic Properties of $R_2Fe_{14}B_{1-x}C_x$ Compounds (R=Y,Nd),' *Journal of Magnetism and Magnetic Materials*, 80:31–26 (1989).

(Continued)

*Primary Examiner*—Kiley Stoner

(57) ABSTRACT

A permanent magnet alloy and method for production thereof. The permanent magnet alloy has a rare earth element including Nd, B, Fe, C, and oxygen, with additions of Co and at least one of Cu, Ga and Ag. The alloy may be produced by contacting particles thereof with carbon- and oxygen-containing material to achieve desired carbon and oxygen contents.

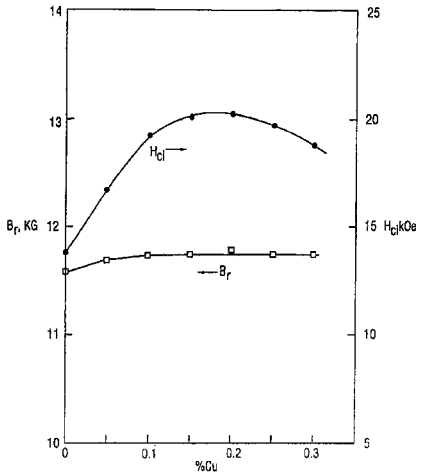

OTHER PUBLICATIONS

Kowalczyk et al., 'Spin Phase Diagrams and Magnetic Anisotropy in $Nd_2Fe_{14-x}M_xB$ Compounds (M=Si, Cr and Cu),' *J. Magn. Mang. Mater.*, 83(1–3):147–148 (1990).

Leonowicz, Magnetic Properties and Microstructure of $Nd_{16}Fe_{76-x}M_xB_8$ Magnets (M=Ga, Cr, Nb, Bi, Sn, Zr, W, V, Mo, Mn), *Journal of Magnetism and Magnetic Materials*, 83:211–213 (1990).

Matsuura, et al., 'Magnetic properties of the $Nd_2(Fe_{1-x}Co_x)_{14}$ system,' *Appl. Phys. Lett.*, 46(3):308–310 (1985).

Quan, et al., 'The Effects of Ga Addition on the Structure and Magnetic Properties of $Nd_2Fe_{14}B$ Compounds,' *Solid State Communications*, 72(9):955–957 (1989).

Tsutai, et al., 'Effect of Ga addition to NdFeCoB on their magnetic properties,' *Appl. Phys. Lett.*, 51(13):1043–1045 (1987).

Xie, et al., 'Effect of Ga and Nb Addition on the Magnetic Properties of the $Nd_2(Fe, Co)_{14}B$ Compounds,' *Journal of Magnetism and Magnetic Materials*, 75:361–365 (1988).

Xie, et al., 'First–order magnetization process and spin phase diagram of $Nd_2Fe_{14-x}Ga_xB$ and $Nd_2Fe_{11.5-x}Co_{2.5}Ga_xB$,' *Phys. Rev.*, B41:7162–7166 (1990).

Abstract of JP 4–184901, Jul. 1992.

Abstract of JP 6–124816, May 1994.

Abstract of JP 6–168808, Jun. 1994.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 4 is cancelled.

Claims 1, 5, 6, 7 and 8 are determined to be patentable as amended.

Claims 2 and 3, dependent on an amended claim, are determined to be patentable.

New claims 9–12 are added and determined to be patentable.

1. A permanent magnet alloy consisting essentially of, in weight percent [.]*:*

27 to 35 of a rare earth element, including Nd in an amount of at least 50 percent of the total rare earth element content;

0.8 to 1.3 B;

0.5 to 5 Co;

40 to 75 Fe;

0.03 to 0.3 C;

0.2 to 0.8 oxygen; and

*Ga and Cu, the combined amount of the Ga and Cu being* 0.05 to 0.5 [of at least one of Cu, Ga, and Ag] *wt* % , with said alloy exhibiting intrinsic coercivity of at least 10kOe while maintaining substantially the same remanence and energy product compared to said alloy absent said Co, *Ga,* and [at least one of] Cu[, Ga, and Ag].

5. The permanent magnet alloy of claim [4 ] *12*, wherein at least one of Pr or La is substituted for up to 50 percent of the Nd.

6. The permanent magnet alloy of claim [4 ] *12*, wherein at least one of Dy or Tb is substituted for up to 50 percent of the Nd.

7. The permanent magnet alloy of [claims] *claim* 1 [or 4], including up to 5 percent of at least one additional element selected from the group consisting of Al, Si, Sn, Zn, Nb, Mo, V, W, Cr, Zr, Hf, Ti, and Mg.

8. The permanent magnet alloy of [claims] *claim* 1 [or 4], having 0.9 to 1.2 B, 0.05 to 0.15 C, and 0.3 to 0.8 oxygen.

*9. The permanent magnet alloy of claim 1, having 0.1 to 0.4 Ga.*

*10. The new permanent magnet alloy of claim 1, having 0.1 to 0.4 Cu.*

*11. A new permanent magnet alloy consisting essentially of, in weight percent:*

*27 to 35 of a rare earth element, including Nd in an amount of at least 50 percent of the total rare earth element content;*

*0.8 to 1.3 B;*

*0.5 to 5 Co;*

*40 to 75 Fe;*

*0.03 to 0.3 C;*

*0.2 to 0.8 oxygen; and*

*Ga and Ag, or Ga, Cu, and Ag, the combined amount of the Ga and Ag, or of the Ga, Cu, and Ag, being 0.05 to 0.5 wt %,*

*with said alloy exhibiting intrinsic coercivity of at least 10kOe while maintaining substantially the same remanence and energy product compared to said alloy absent said Co, Ga and Ag or absent said Co, Ga, Cu, and Ag.*

*12. The permanent magnet alloy of claim 11, having 0.1 to 0.4 Ag.*

* * * * *